United States Patent [19]

Sterel

[11] 4,330,018

[45] May 18, 1982

[54] SHUTTLE RETURN CONVEYOR MECHANISM

[75] Inventor: Willem Sterel, Wiesendangen, Switzerland

[73] Assignee: Sulzer Brothers Ltd., Winterthur, Switzerland

[21] Appl. No.: 224,735

[22] Filed: Jan. 13, 1981

Related U.S. Application Data

[63] Continuation of Ser. No. 68,655, Aug. 22, 1979.

[30] Foreign Application Priority Data

Aug. 31, 1979 [CH] Switzerland ..... 9192/78

[51] Int. Cl.[3] ..... D03D 47/24

[52] U.S. Cl. ..... 139/439; 198/725

[58] Field of Search ..... 139/436, 439; 198/725, 198/727, 728, 730, 731, 733

[56] References Cited

U.S. PATENT DOCUMENTS

| | | | |
|---|---|---|---|
| 2,578,205 | 12/1951 | Pfarrwaller | 139/439 |
| 2,808,853 | 10/1957 | Pfarrwaller | 139/439 |
| 3,765,458 | 10/1973 | Ziegler et al. | 139/439 |

FOREIGN PATENT DOCUMENTS

| | | | |
|---|---|---|---|
| 2647123 | 10/1976 | Fed. Rep. of Germany | 139/431 |
| 2712431 | 7/1978 | Fed. Rep. of Germany | 139/439 |

*Primary Examiner*—Henry Jaudon

*Attorney, Agent, or Firm*—Kenyon & Kenyon

[57] ABSTRACT

The conveyor belt for the shuttle return conveyor mechanism is formed with a support on the upper surface for laterally supporting a series of shuttles thereon and drivers which act as abutments for moving the shuttles from the catching mechanism to the picking mechanism of the weaving machine. The shuttles are thus conveyed directly on the conveyor belt and do not require separate guides or channels in the weaving machines.

13 Claims, 8 Drawing Figures

SHUTTLE RETURN CONVEYOR MECHANISM

This is a continuation of application Ser. No. 068,655, filed Aug. 22, 1979.

This invention relates to a shuttle return conveyor mechanism.

As is known, in weaving machines which are operated with weft picking projectiles, such as shuttles, for example wherein ten to twenty shuttles are projected through a shed in successive fashion from a catching side to a picking side of the weaving machine, the shuttles are usually returned from the catching side to the picking side by various mechanisms. In some cases, the shuttles are returned via an endlessly rotating conveyor chain provided with drivers. For example, it has been known to position the shuttles laterally of the endless chain within a groove in the weaving machine frame or in a return casing accommodating the complete return mechanism and to use the drivers to push the shuttles along the groove. In such cases, the drivers may, for example, consist of a plain or plastics-coated bent portion of a side plate of the conveyor chain. The drivers may also be formed of individual pieces which are snapped over the chain, e.g. over a pair of side plates of the chain, by spring action so as to be held in place in a positive manner via apertures adapted to the shapes of the side plates.

However, these return conveyor mechanisms have several disadvantages. Specifically, the shuttles which are guided laterally of the conveyor chain receive impacts from the drivers due to forces occurring as a result of vibrations in the machine, for example due to the beating up of the reed. In addition, vibrations may build up via the drive of the conveyor chain and result in corresponding amplified impacts if the conveyor chain is of a relatively heavy mass. As a result, the shuttles sometimes lead relative to the drivers and may knock against a preceding driver or, at the end of the return mechanism, against other parts of the weaving machine. This may interfere with operation and the shuttles themselves. Further, the parts that they knock against may be damaged or worn so that both the shuttles and these other parts of the weaving machine require replacement.

In one known return mechanism, such as described in Swiss Pat. No. 606,554, the conveyor is in the form of a return chain or belt with a support for the shuttles and the drivers are disposed at the top of the conveyor. Since the shuttles are carried on the conveyor itself in this mechanism, the above mentioned risks of damage due to impacts of the drivers is reduced. However, here again, a guide groove or guide channel is used with fixed side guide walls to support the shuttles. Consequently, the return mechanism is not only complicated but there is also a risk of the shuttles jamming in the guide channel particularly upon entry of the shuttles into the picking mechanism and upon transfer from the catching mechanism to the return mechanism. Further, a separate guide of this kind requires a considerable amount of space. This has an unfavorable effect particularly in the case of shuttles being transported on the the conveyor since the system already requires more space as compared with the lateral drive for the shuttles. Still further, the rubbing of the shuttles against the guide walls is an additional source of noise and wear.

Accordingly, it is an object of this invention to provide a shuttle return conveyor mechanism having reduced susceptability to inertia forces and wear so that the life of the drivers and the shuttles is lengthened.

It is another object of the invention to provide a shuttle return conveyor mechanism for a weaving machine which requires limited space.

It is another object of the invention to provide a shuttle conveyor mechanism of simple construction.

It is another object of the invention to reduce the wear on shuttles which are returned from a catching side to a picking side of a weaving machine.

Briefly, the invention provides an endless conveyor belt for a shuttle conveyor mechanism which has support means on at least one longitudinal side for laterally supporting a series of shuttles and a plurality of spaced apart drivers for individually abutting each shuttle supported in the support means.

The effect of this construction is that the return mechanism can directly accommodate the shuttles (weft picking projectiles) without requiring any separate guide channels or walls. The conveyor mechanism can thus be disposed directly beneath the picking and catching mechanisms of a weaving machine without requiring excessive extra space.

In one embodiment, the support means includes a plurality of longitudinally spaced supports which are distributed over the length of the conveyor mechanism for individually supporting the shuttles.

Where the endless belt is constructed of a plurality of interconnected plates which define an endless chain, each support is mounted on the chain. In this regard, each support has a pair of upstanding walls to define a U-shaped channel for receiving at least a part of a shuttle therein and may be pushed onto the chain, for example in a snap fit relation.

In another embodiment, the endless belt may be toothed while the support means is integral with the belt.

These and other objects and advantages of the invention will become more apparent from the following detailed description taken in conjunction with the accompanying drawings in which:

FIG. 1 diagrammatically illustrates a shuttle return conveyor mechanism according to the invention;

Figure 1:
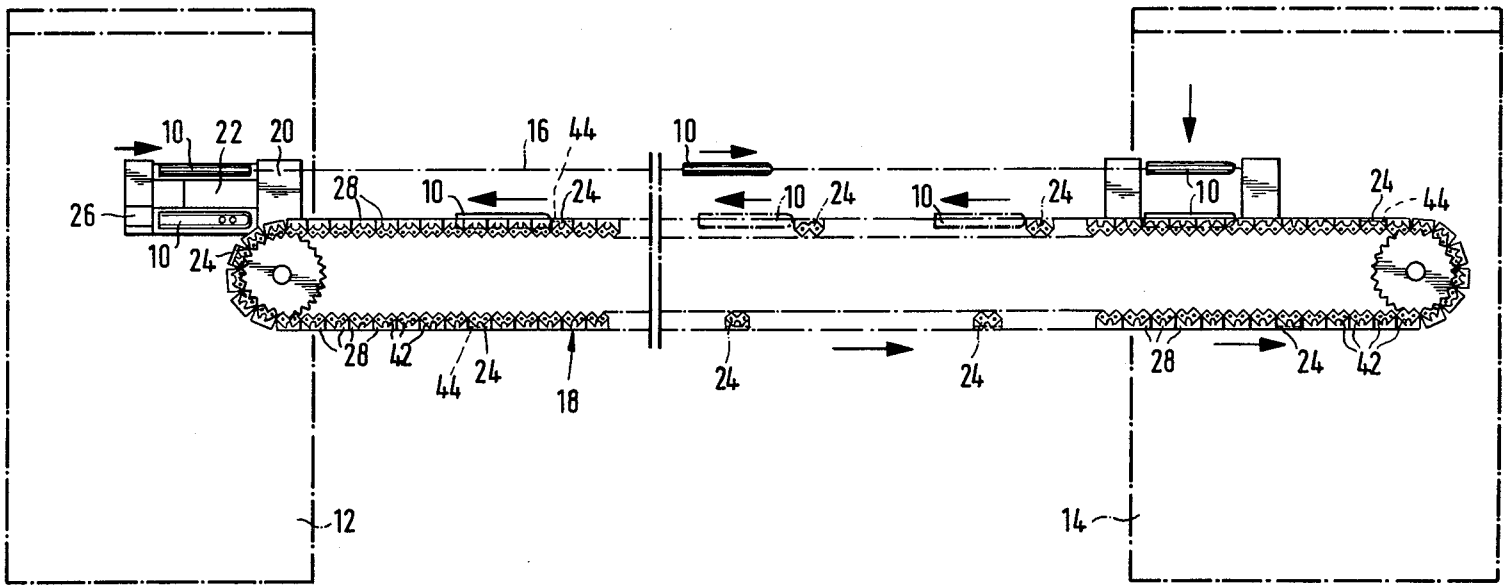

Referring to FIG. 1, only those parts of a weaving machine necessary for an understanding of the invention are illustrated. To this end, the weaving machine has a picking mechanism 12 on one side of a shed (not shown) for picking a series of shuttles (weft picking projectiles) 10 through the shed to a catching mechanism 14 on the opposite side of the machine along a picking line 16. In addition, a shuttle return conveyor mechanism 18 is employed to return each shuttle 10 from the catching mechanism 14 to the picking mechanism 12. As indicated, a plurality of drivers 24 are mounted on the conveyor mechanism 18 to push and position the shuttles 10 in the picking mechanism 12 for centering each shuttle 10 before entry of the shuttle into the picking mechanism 12. An end block 20 also acts as a bearing for a rotatably mounted shuttle lift 22 which lifts a received shuttle 10 into a picking position as is known. A shuttle stop 26 is also positioned downstream of the block 20. During operation, each shuttle 10 is advanced by a driver 24 into the lift 22 until abutting against the stop 26.

Figure 2:
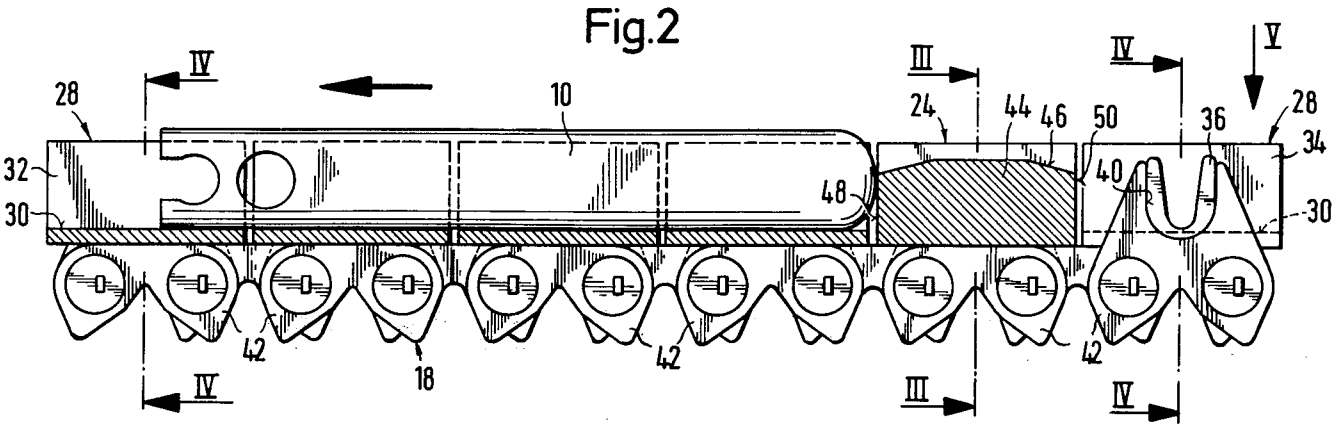
FIG. 2 illustrates a partial longitudinal sectional view of the return conveyor mechanism of FIG. 1 to an enlarged scale.

Referring to FIG. 2, the return conveyor mechanism 18 is constructed of a plurality of interconnected plates 42 which are connected together in any suitable fashion, such as via pins, to define an endless chain. As indicated in FIG. 1, the chain is looped about a pair of rollers and is driven in the direction indicated by arrows. In addition, the conveyor mechanism 18 has a plurality of U-shaped links 28 mounted on one side of the chain to define a series of longitudinally spaced support means for individually receiving and laterally supporting a shuttle 10 therein. The drivers 24 are mounted on the chain in alternating manner with the support means defined by the links 28 in order to abut a respective shuttle 10 in a respective support means.

Figure 5:
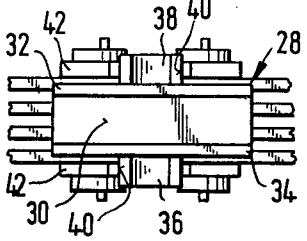
FIG. 5 illustrates a view taken in the direction of arrow V in FIG. 2.
Figure 4:
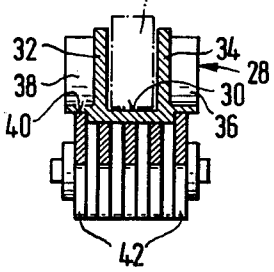
FIG. 4 illustrates a view taken on line IV—IV of FIG. 2.

As shown in FIGS. 2, 4, and 5, each link 28 has a support base 30 on which a part of a shuttle 10 is received and a pair of upstanding walls 32, 34 to define a U-shaped channel for the shuttle 10. Each sidewall 32, 34 carries an integral U-shaped clamping member 36, 38 on the outside which is held in friction fit relation in a corresponding recess 40 in the outermost side plates 42 of the chain. To this end, each link 28 and the integral clamping members 36, 38 are made from plastic.

Alternatively, each link 28 may be fixed to the side plates 42 by gluing or riveting. Further, the links 28 may be injection-molded around the side plates 42.

Figure 3:
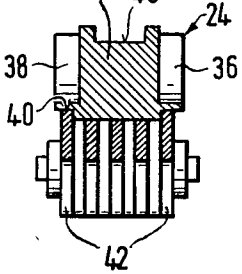
FIG. 3 illustrates a view taken on line III—III of FIG. 2.

Referring to FIGS. 2 and 3, each driver 24 is fixed to the side plates 42 by clamping members 36, 38 in the same way as the links 28. In addition, each driver 24 has a solid body 44 having a top boundry surface 46 between two upstanding flanges and front and rear walls 48, 50 each of which act as an abutment surface for a shuttle 10.

As indicated in FIG. 2, during transport, each shuttle 10 is held in an upright manner in a channel formed by a plurality of successive links 28 and bounded longitudinally by the abutment surfaces 48, 50 of two drivers 24.

Figure 6:
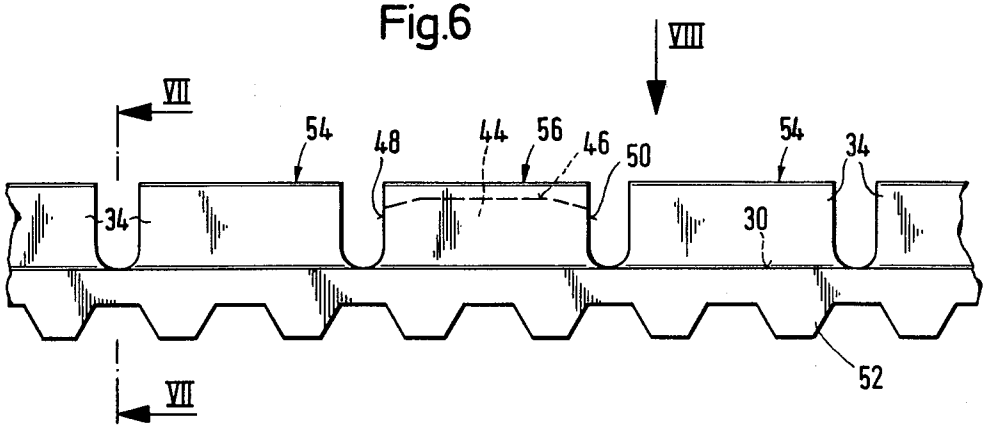
FIG. 6 illustrates a side elevational view of a further embodiment of a return conveyor mechanism according to the invention taken in the direction of arrow VI of FIG. 8.
Figure 7:
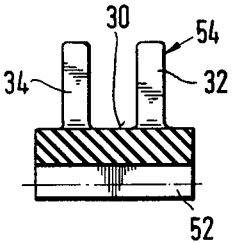
FIG. 7 illustrates a view taken on line VII—VII of FIG. 6.
Figure 8:
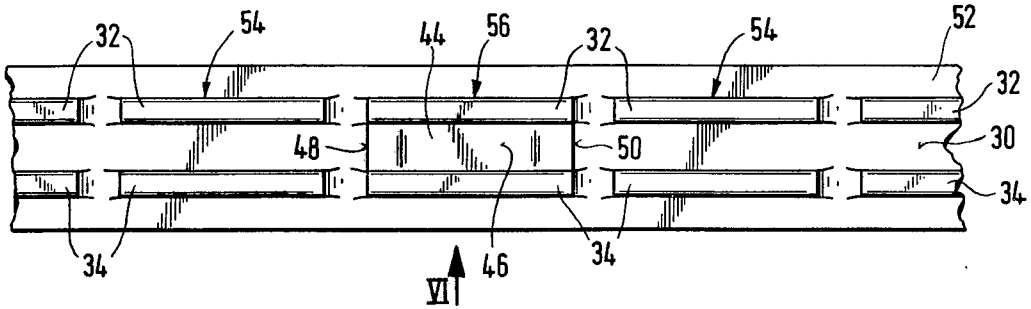
FIG. 8 illustrates a view taken in the direction indicated by arrow VIII in FIG. 6.

Referring to FIGS. 6 to 8, wherein like reference characters indicate like parts as above, the shuttle return conveyor may alternatively be constructed as a one piece endless belt having a plurality of teeth 52 on an inner surface and a plurality of links 54 and drivers 56 integrally mounted on an outer surface in alternating manner. As shown, each link 54 is defined by a pair of side walls 32, 34 while the drivers 56 are defined by solid bodies 44 as above. As indicated, the pairs of side walls 32, 34 define a series of longitudinally spaced U-shaped support means for individually receiving and laterally supporting a shuttle 10.

In this embodiment, the entire belt is made from plastics, or rubber, with steel ply or glass fiber reinforcement. In this case, the support can also form a cohesive side wall so that it is only necessary to provide trough-shaped recesses in the belt to receive the shuttles. The side walls 32, 34 can alternatively, be apertured or be constructed in the form of a fence by means of vertical projections.

What is claimed is:

1. An endless conveyor belt for a shuttle return conveyor mechanism, said endless belt having support means on at least one longitudinal side for laterally supporting a series of shuttles in an upright manner and a plurality of spaced apart drivers for individually abutting each shuttle supported in said support means.

2. An endless conveyor belt as set forth in claim 1 wherein said support means includes a plurality of longitudinally spaced supports for individually supporting a respective shuttle of a series of shuttles in an upright manner.

3. An endless conveyor belt as set forth in claim 2 wherein said belt includes a plurality of interconnected plates defining an endless chain, each said support being mounted on said chain.

4. An endless conveyor belt as set forth in claim 3 wherein each support has a pair of upstanding walls to define a U-shaped channel for receiving at least a part of a shuttle therein in an upright manner.

5. An endless conveyor belt as set forth in claim 4 wherein each support is pushed onto said chain.

6. An endless conveyor belt as set forth in claim 1 wherein said belt is toothed and said support means is integral with said belt.

7. A shuttle return conveyor mechanism comprising a plurality of interconnected plates defining an endless chain;

a plurality of U-shaped links mounted on at least one side of said chain to define a series of longitudinally spaced support means for individually receiving and laterally supporting a shuttle on opposite sides in an upright manner therein; and a plurality of drivers mounted on said chain in alternating manner with said support means to abut a respective shuttle in a respective support means.

8. A shuttle return conveyor mechanism as set forth in claim 7 wherein each link is made of plastic.

9. A shuttle return conveyor mechanism as set forth in claim 8 wherein each link is held in friction-fit relation on said chain.

10. A shuttle return conveyor mechanism as set forth in claim 7 wherein said links are mounted on an upper side of said chain.

11. A shuttle return conveyor mechanism comprising a one-piece endless belt having a plurality of teeth of an inner surface, a pair of side walls on an outer surface defining a series of longitudinally spaced U-shaped support means for individually receiving and laterally supporting a shuttle on opposide sides and in an upright manner therein; and a plurality of drivers mounted on said outer surface in alternating manner with said support means to abut a respective shuttle in a respective support means.

12. In a weaving machine having a picking mechanism for picking a series of shuttles and a catching mechanism, a shuttle return conveyor mechanism for returning each shuttle from said catching mechanism to said picking mechanism, said conveyor mechanism including an endless belt having support means on at least one longitudinal side for laterally supporting a series of shuttles in an upright manner and a plurality of spaced apart drivers for individually abutting each shuttle supported in said support means.

13. In a weaving machine as set forth in claim 12 wherein said support means includes a plurality of supports, each support having a pair of upstanding walls to define a U-shaped channel for receiving at least a part of a shuttle in an upright manner.

* * * * *